US006499452B2

(12) United States Patent
Ma

(10) Patent No.: US 6,499,452 B2
(45) Date of Patent: Dec. 31, 2002

(54) SELECTABLE 2-STROKE/4-STROKE CAMSHAFT DRIVE SYSTEM

(76) Inventor: Jonathan Austin Ma, 30 Creekview Rd., South Woodham Ferrers, Essex, CM35YL (GB)

( * ) Notice: Subject to any disclaimer, the term of this patent is extended or adjusted under 35 U.S.C. 154(b) by 0 days.

(21) Appl. No.: 10/092,134

(22) Filed: Mar. 6, 2002

(65) Prior Publication Data

US 2002/0117133 A1 Aug. 29, 2002

Related U.S. Application Data

(63) Continuation of application No. PCT/GB01/03116, filed on Jul. 12, 2001.

(51) Int. Cl.[7] ..... F01L 1/352; F02B 69/06

(52) U.S. Cl. ..... 123/90.17; 123/90.31; 123/21

(58) Field of Search ..... 123/90.15, 90.17, 123/90.31, 21, DIG. 7

(56) References Cited

U.S. PATENT DOCUMENTS

| | | | | |
|---|---|---|---|---|
| 2,178,152 A | | 10/1939 | Walker | |
| 4,305,352 A | | 12/1981 | Oshima et al. | |
| 4,476,823 A | * | 10/1984 | Williams | 123/90.12 |
| 4,530,318 A | * | 7/1985 | Semple | 123/90.17 |
| 4,907,544 A | | 3/1990 | Burrham | |
| 5,680,836 A | * | 10/1997 | Pierik | 123/90.17 |
| 5,680,837 A | | 10/1997 | Pierik | |

FOREIGN PATENT DOCUMENTS

| | | |
|---|---|---|
| DE | 38 42 267 A1 | 6/1990 |
| EP | 0 918 142 A2 | 5/1999 |
| JP | 4-12422 A | 4/1992 |
| JP | 4-143423 A | 5/1992 |
| JP | 04 234508 A | 8/1992 |

* cited by examiner

*Primary Examiner*—Weilun Lo
(74) *Attorney, Agent, or Firm*—Shalom Werteberger; Saltamar Innovations

(57) ABSTRACT

A camshaft drive system is described for a selectable two-stroke/four-stroke internal combustion engine with exhaust and intake poppet valves opened and closed by at least one camshaft. In a preferred embodiment of the system, the camshaft is connected permanently to a planetary gear set which is driven continuously by the engine crankshaft, and means are provided for setting the planetary gear set in one of two selectable stable modes to function either as a gear box or as a rigid coupling.

22 Claims, 2 Drawing Sheets

SELECTABLE 2-STROKE/4-STROKE CAMSHAFT DRIVE SYSTEM

This application is a continuing application of PCT application No. PCT/GB01/03116, filed Jul. 12, 2001 and claims the right of priority thereto 35 USC 120.

FIELD OF THE INVENTION

The present invention relates to a camshaft drive system for operating an internal combustion engine according to the two-stroke cycle or the four-stroke cycle.

BACKGROUND OF THE INVENTION

Conventional internal combustion engines operate according to thermodynamic principles following either the two-stroke cycle or the four-stroke cycle and are commonly classified as two-stroke engines or four-stroke engines respectively. Both type of engines can operate using a range of fuels including gasoline, diesel, alcohol and gaseous fuels; the fuel can be introduced into the engine by a range of devices including carburettors and fuel injectors into the air intake system and fuel injectors aimed directly into the engine cylinder; and the fuel-air mixture can be ignited by a range of methods including spark ignition and compression ignition. Each engine cycle type has different merits and shortcomings making it a subject of continuous debate as to which is more suitable for automotive application taking into account various parameters such as power density, fuel consumption, exhaust emissions, noise, vibration, engine size, weight and cost etc. Currently, the automotive manufacturer must first decide on the engine cycle type, then design the engine accordingly.

SUMMARY OF THE INVENTION

With a view of combining the merits of both engine cycle types, there is provided a camshaft drive system for a selectable two-stroke/four-stroke internal combustion engine with exhaust and intake poppet valves opened and closed by at least one camshaft, wherein the camshaft is connected permanently to a planetary gear set which is driven continuously by the engine crankshaft, and wherein means are provided for setting the planetary gear set in one of two selectable stable modes to function either as a gear box or as a rigid coupling.

In a preferred embodiment of the invention, the camshaft is driven by the planetary gear set according to the selectable mode at either the same speed as the engine crankshaft or half the speed of the engine crankshaft, and the phasing of the camshaft in relation with the crank angle position of the piston is adjustable using the planetary gear set to position the exhaust and intake gas exchange events appropriately for either the two-stroke or the four-stroke engine cycle respectively.

Preferably, the planetary gear set is mounted concentrically to the camshaft. Alternatively, it may be mounted concentrically to the engine crankshaft or it may be mounted separately next to the camshaft and the crankshaft.

Various configurations are possible in using the planetary gear set to drive the camshaft according to the present invention. The input from the engine may be connected to any one of the three members of the planetary gear set which may be the ring gear, the sun gear or the planetary gear carrier, the output to the camshaft may be connected to any one of the remaining two members, and the mode setting means may be provided in the remaining last member which is the reaction member between the input and output members.

In the case where the planetary gear carrier is the reaction member, idler gears coupled with the planetary gears may be additionally provided on the planetary gear carrier such that the ring gear and the sun gear rotate in the same direction.

In the invention, the means for setting the planetary gear set to function as a gear box is a device for holding the reaction member of the gear set stationary relative to a fixed datum so that the gears rotate relative to one another within the gear set, whereas the means for setting the planetary gear set to function as a rigid coupling is a device for holding the reaction member of the gear set stationary relative to either the rotating input member or the rotating output member so that the gears are locked relative to one another within the gear set and the whole assembly rotate together.

In a preferred example, the ring gear is the input member driven by the engine at half crankshaft speed, the sun gear is the output member connected to the camshaft, and the planetary gear carrier is the reaction member of the gear set. The speed ratio between the ring gear and the sun gear is 1:2.

In this example, means are provided for setting the planetary gear carrier in one of two selectable stable modes such that in the two-stroke mode the carrier is held stationary relative to the engine frame so that the gear set acts as a gear box, and in the four-stroke mode the carrier is held stationary relative to the rotating ring gear so that the entire gear set acts as a rigid coupling. Additionally, means are provided for allowing the carrier to slip and rotate relative to the engine frame or relative to the rotating ring gear in order to adjust the phasing and the speed of the camshaft during a mode change.

In operation, when the two-stroke mode is selected, the carrier, which has been held stationary relative to the rotating ring gear in the four-stroke mode, is first allowed to slip and rotate relative to the rotating ring gear in order to adjust the phasing and the speed of the camshaft progressively towards the two-stroke mode, at which point the carrier is then held stationary relative to the engine frame thereafter. In this case, the planetary gear set acts as a gear box in which the camshaft is driven at twice the speed of the ring gear and each engine valve along the camshaft is opened and closed at a predetermined two-stroke valve timing once during every engine revolution consistent with the two-stroke cycle.

In addition to the above, a combination of various operating parameters in the engine necessary for executing the two-stroke cycle is implemented, and this would be obvious to a person familiar with the state-of-the-art. For example, an air blower would be necessary to supply pressurised air for the two-stroke scavenging process and the frequency and timing of the fuel injection and/or spark ignition would be scheduled appropriately.

When the four-stroke mode is selected, the carrier, which has been held stationary relative to the engine frame in the two-stroke mode, is first allowed to slip and rotate relative to the engine frame in order to adjust the phasing and the speed of the camshaft progressively towards the four-stroke mode, at which point the carrier is then held stationary relative to the rotating ring gear thereafter. In this case, the planetary gear set acts as a rigid coupling in which the camshaft is driven at the same speed as the ring gear and each engine valve along the camshaft is opened and closed at a predetermined four-stroke valve timing once during every two engine revolutions consistent with the four-stroke cycle.

In addition to the above, a combination of various operating parameters in the engine necessary for executing the four-stroke cycle is implemented, and this would be obvious to a person familiar with the state-of-the-art. The air blower for two-stroke operation may in this case be used to supply boosted air for four-stroke operation.

The above example is only one of many possible configurations for the camshaft to be driven by a mode selectable planetary gear set of the present invention. In another example, the planetary gear carrier is the input member driven at half crankshaft speed, the sun gear is the output member connected to the camshaft, and the ring gear is the reaction member of the gear set. The speed ratio between the carrier and the sun gear is 1:2.

In this case, the ring gear may be set in one of two selectable modes such that in the two-stroke mode the ring gear is held stationary relative to the engine frame so that the planetary gear set acts as a gear box and the camshaft is driven at crankshaft speed, and in the four-stroke mode the ring gear is held stationary relative to the carrier so that the entire gear set acts as a rigid coupling and the camshaft is driven at half crankshaft speed.

In a further example, the sun gear is the input member driven at crankshaft speed, the planetary gear carrier is the output member connected to the camshaft, and the ring gear is the reaction member of the gear set. The speed ratio between the sun gear and the carrier is 2:1.

In this case, the ring gear may be set in one of two selectable modes such that in the two-stroke mode the ring gear is held stationary relative to the carrier so that the entire gear set acts as a rigid coupling and the camshaft is driven at crankshaft speed, and in the four-stroke mode the ring gear is held stationary relative to the engine frame so that the epicycle gear set acts as a gear box and the camshaft is driven at half crankshaft speed.

The principle of operating a planetary gear set in several selectable modes is well known and is commonly used in automotive automatic transmission systems for driving a vehicle. The present invention proposes to apply the same principle for driving a camshaft in order to enable the engine to be operated in either the two-stroke or the four-stroke mode with smooth and rapid transition and with the minimum risk of misfire during a mode change even at high speed. This provides a camshaft drive which is permanently in mesh and avoids the abruptness and uncertainty caused by temporarily decoupling and then re-coupling the camshaft and the crankshaft as proposed in the previously known systems such as U.S. Pat. No. 4,907,544 and U.S. Pat. No. 2,178,152 which are unacceptable for automotive application.

The technology for controlling the planetary gear set to operate in the selectable modes and to change mode smoothly and imperceptibly using brakes, clutches, and sensors is well advanced in the automatic transmission field and may be transferred readily to the camshaft drive system of the present invention.

BRIEF DESCRIPTION OF THE DRAWING

The invention will now be described further, by way of example, with reference to FIG. 1 which is a schematic view of a preferred embodiment of the invention in which two planetary gear sets are used to drive separately the intake and exhaust camshafts of an internal combustion engine.

DETAILED DESCRIPTION OF THE PREFERRED EMBODIMENT

Figure 1:
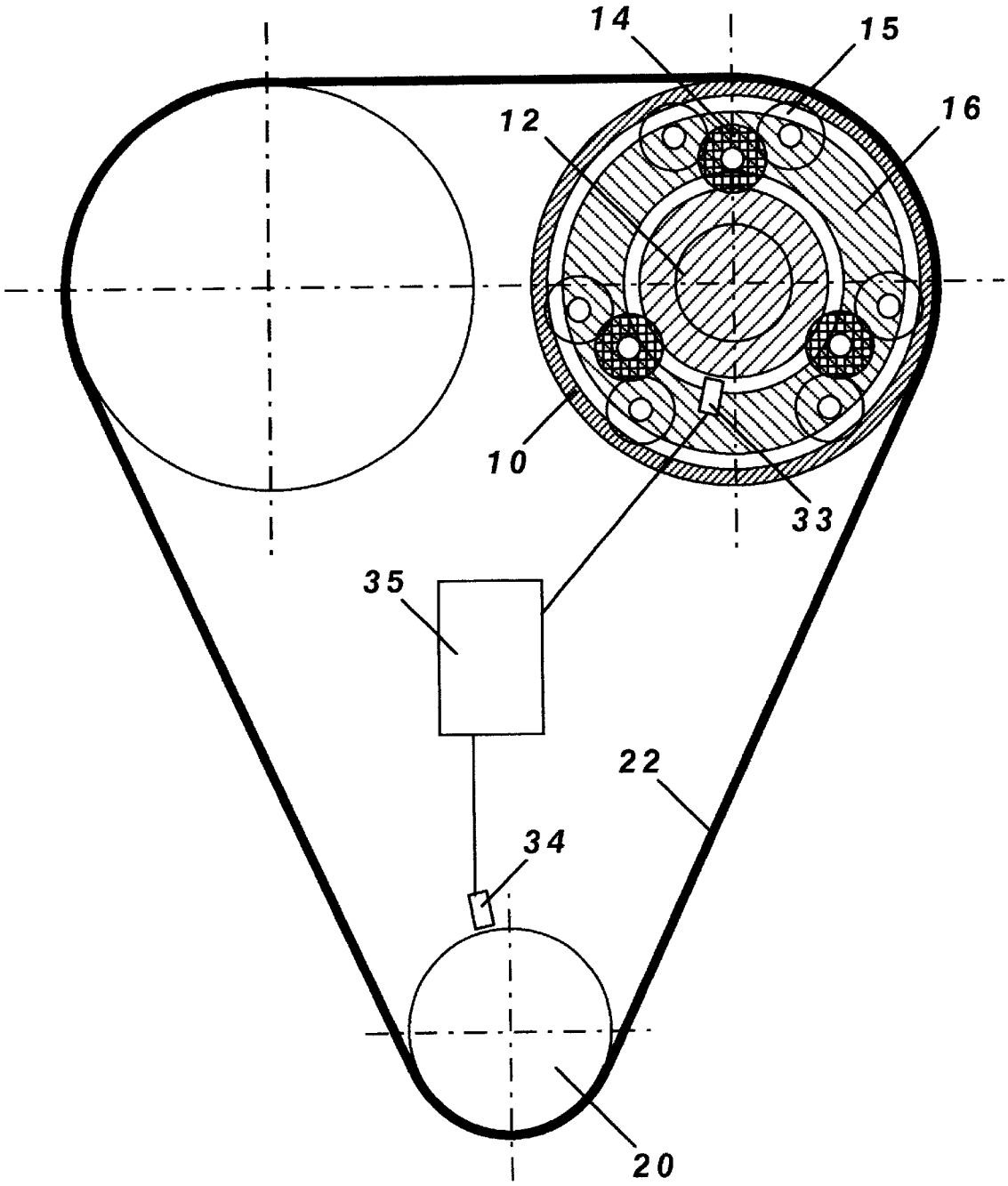
Figure 2:
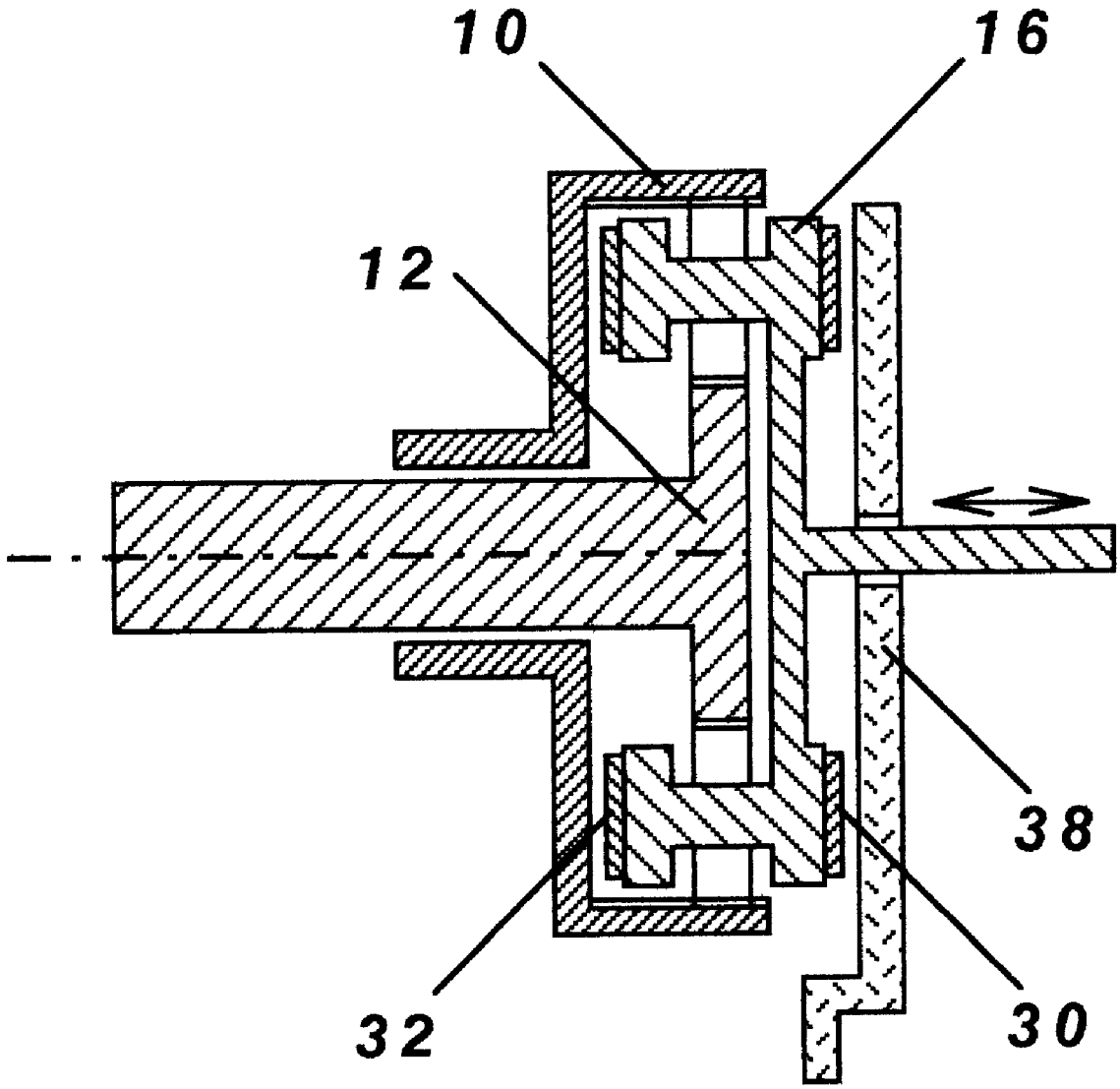
FIG. 2 depicts one preferred embodiment showing a side view with an example of a brake and a clutch arrangement.

FIG. 1 shows two planetary gear sets each comprising a ring gear 10, a sun gear 12, and three planetary gears 14 with additional idler gears 15 mounted on a carrier 16. The speed ratio between the ring gear 10 and the sun gear 12 is 1:2. The ring gear 10 is the input member driven at half crankshaft speed by a timing belt or chain 22 from the crankshaft 20 of the engine, the sun gear 12 is the output member connected directly to one camshaft of the engine, and the carrier 16 is the reaction member.

Respective braking 30 or clutching 32 means are provided for engaging the carrier 16 to either the engine frame 38 or the rotating ring gear 10, enabling the carrier 16 to be held stationary relative to either the engine frame or the rotating ring gear 10, and to slip and rotate when desired relative to either the engine frame or the rotating ring gear 10. The use of such braking and clutching means is common practice in the automatic transmission field for selecting between different speed ratios and direct drive, and would be obvious to a person familiar with the state-of-the-art.

In operation, when the two-stroke mode is selected, the carrier 16 in each planetary gear set, which has been held stationary relative to the rotating ring gear 10 in the four-stroke mode, is first allowed to slip and rotate relative to the rotating ring gear 10 in order to adjust the phasing and the speed of each camshaft progressively towards the two-stroke mode, at which point the carrier 16 is then held stationary relative to the engine frame thereafter. In this case each planetary gear set acts as a gear box in which each camshaft is driven at twice the speed of the ring gear 10 and each engine valve along the camshaft is opened and closed according to a predetermined two-stroke valve timing once during every engine revolution.

When the four-stroke mode is selected, the carrier 16 in each planetary gear set, which has been held stationary relative to the engine frame in the two-stroke mode, is first allowed to slip and rotate relative to the engine frame in order to adjust the phasing and the speed of each camshaft progressively towards the four-stroke mode, at which point the carrier 16 is then held stationary relative to the rotating ring gear 10 thereafter. In this case, each planetary gear set acts as a rigid coupling in which each camshaft is driven at the same speed as the ring gear 10 and each engine valve along the camshaft is opened and closed according to a predetermined four-stroke valve timing once during every two engine revolutions.

It would be clear in the invention that the same cam profile carried on the camshaft driven at one or the other selectable mode would automatically give the appropriate duration of valve opening to suit each engine cycle mode respectively, namely, the two-stroke valve opening duration would be half the four-stroke valve opening duration.

It would also be clear in the invention that the phasing of the camshaft in relation with the crankshaft may at any time be re-positioned using the planetary gear set by briefly allowing the reaction member to slip while operating in either the two-stroke or the four-stroke mode.

The invention enables a selectable two-stroke/four stroke internal combustion engine to be used in a road vehicle to suit different operating conditions resulting in a better combination of engine performance, fuel economy, exhaust emissions, noise, vibrations, and drive quality while the mode transitions could be controlled and refined to be imperceptible to the driver.

What is claimed is:

1. A camshaft drive system for a selectable two stroke/four stroke internal combustion engine, having a crankshaft and a plurality of poppet valves operated by at least one camshaft to coordinate gas exchange events, the camshaft drive system comprising:

a planetary gear set comprising a ring gear, a sun gear, at least one planetary gear, and a planetary gear carrier; said planetary gear set being coupled to the camshaft;

setting means for setting said planetary gear set in at least a first or a second selectable modes, wherein the planetary gear set operates as a gear box in said first mode and as a rigid coupling in said second mode;

wherein said planetary gear set is adapted to be driven in synchronous relationship to the engine crankshaft.

2. A camshaft drive system as claimed in claim 1, wherein the camshaft is driven by the planetary gear set according to the selectable mode at either the same speed as the engine crankshaft or half the speed of the engine crankshaft, and wherein the phasing of the camshaft in relation with the crankshaft angle position is adjustable using the planetary gear set to position exhaust and intake gas exchange events appropriately for either the two-stroke or the four-stroke engine cycle respectively.

3. A camshaft drive system as claimed in claim 1, wherein an input from the engine is connected to any one member of the planetary gear set which may be the ring gear, the sun gear or the planetary gear carrier, the output to the camshaft is connected to any one of the remaining two members, and the setting means is operable on the remaining last member which acts as reaction member between the input and output members.

4. A camshaft drive system as claimed in claim 3, further comprising at least one idler gear coupled with the planetary gear such that the ring gear and the sun gear rotate in the same direction.

5. A camshaft drive system as claimed in claim 3, wherein the setting means are constructed for setting the reaction member of the planetary gear set in one of two selectable stable modes such that in one mode the reaction member is held stationary relative to the engine frame so that the gear set acts as a gear box, and in the other mode the reaction member is held stationary relative to the rotating input or output members so that the entire gear set acts as a rigid coupling.

6. A camshaft drive system as claimed in claim 3, further comprising adjusting means for allowing the reaction member of the planetary gear set to slip and rotate relative to a fixed point or relative to at least one rotating member, in order to adjust the phasing and the speed of the camshaft during a mode change.

7. A camshaft drive system as claimed in claim 3, further comprising respective braking and clutching means for holding the reaction member of the planetary gear set in respective selectable modes, and for allowing the reaction member to slip and rotate relative to the engine frame or relative to the rotating input and output members.

8. A camshaft drive system as claimed in claim 6, further comprising at least one sensor in a closed-loop control system for sensing the angular positions of the camshaft and the crankshaft, thereby enabling accurate control of the phasing and the speed of the camshaft progressively during a mode change.

9. A camshaft drive system as claimed in claim 7 wherein sensors are provided in a closed-loop control system for sensing the angular positions of the camshaft and the crankshaft, thereby enabling accurate control of the phasing and the speed of the camshaft progressively during a mode change.

10. A camshaft drive system as claimed in claim 1 wherein said setting means comprise a brake and a clutch adapted to operate in coordination with one another to grip or release a member of said planetary gear according to said selectable modes, said member selected from a group consisting of the sun gear, the gear, and the planetary gear carrier.

11. A camshaft drive system for a selectable two stroke/four stroke internal combustion engine operation, having a crankshaft and a plurality of poppet valves operated by at least one camshaft to coordinate gas exchange events, the camshaft drive system comprising:

a planetary gear set having a plurality of members comprising a ring gear member, a sun gear member, and a planetary gear carrier member; wherein a first of said members being permanently affixed to the camshaft, and a second of said members being coupled to said crankshaft;

a brake coupled to the third member of said planetary gear, said brake being operable for setting said planetary gear set in at least a first or a second selectable mode, wherein the planetary gear set function either as a gear box or as a rigid coupling.

12. The camshaft drive system as claimed in claim 11, further comprising a clutch, and at least one sensor to sense relative position of crankshaft and camshaft, and wherein said clutch is operable to vary said relative position.

13. The camshaft drive system as claimed in claim 11, wherein when operating as a gear box, said planetary gear system is constructed to allow modification of the relative position of said first and second member.

14. A method of selecting between operating an internal combustion engine in a two cycle operation mode, or a four cycle operation mode, said engine having a crankshaft and a plurality of valves operated by a camshaft, wherein selecting between a four cycle and a two cycle operation mode requires modifying of valve timing, the method comprising the steps of:

coupling the crankshaft and the camshaft via a planetary gear set;

operating said gear set in a first or second coupling modes, to select between two cycle engine operation and four cycle engine operation;

wherein when operated in said first coupling mode the planetary gear set rotates the camshaft at the same speed as the crankshaft; and, wherein when operated in said second coupling mode the planetary gear set rotates the camshaft at a speed different than that of the crankshaft.

15. The method of claim 14, further comprising the step of modifying a phasing relationship between said camshaft and crankshaft.

16. The method of claim 15 wherein said step of modifying is performed during transition between the two coupling modes.

17. The method of claim 15 wherein said step modifying is controlled by sensing the relative angular position between said camshaft and crankshaft.

18. A camshaft drive system for a selectable two-stroke/four-stroke internal combustion engine with exhaust and intake poppet valves opened and closed by at least one camshaft, wherein the camshaft is connected permanently to a planetary gear set which is driven continuously by the engine crankshaft, and wherein means are provided for setting the planetary gear set in one of two selectable stable modes to function either as a gear box or as a rigid coupling.

19. A camshaft drive system as claimed in claim 18 wherein sensors are provided in a closed-loop control system for sensing the angular positions of the camshaft and the crankshaft, thereby enabling accurate control of the phasing and the speed of the camshaft progressively during a mode change.

20. The camshaft drive system of claim 1, wherein said planetary gear set is affixed to the camshaft.

21. The camshaft drive system of claim 1, wherein said planetary gear set is affixed to the crankshaft.

22. The camshaft drive system of claim 1, wherein said planetary gear set is mounted separately to the crankshaft and the camshaft.

* * * * *